US010239673B1

(12) United States Patent
Dejonge

(10) Patent No.: US 10,239,673 B1
(45) Date of Patent: Mar. 26, 2019

(54) DOUBLE SAFE CHILD RESISTANT CAP

(71) Applicant: DEJONGE ASSOCIATES, INC., Lake Mary, FL (US)

(72) Inventor: Stuart W. Dejonge, Soaring Eagle Place, PA (US)

(73) Assignee: DeJonge Associates, Inc., Lake Mary, FL (US)

( * ) Notice: Subject to any disclaimer, the term of this patent is extended or adjusted under 35 U.S.C. 154(b) by 0 days.

(21) Appl. No.: 15/932,153

(22) Filed: Feb. 13, 2018

(51) Int. Cl.
*B65D 50/06* (2006.01)
*B65D 50/04* (2006.01)

(52) U.S. Cl.
CPC ..... *B65D 50/04* (2013.01); *B65D 50/067* (2013.01); *B65D 2215/02* (2013.01); *B65D 2215/04* (2013.01)

(58) Field of Classification Search
CPC .. B65D 50/04; B65D 50/067; B65D 2215/02; B65D 2215/04; B65D 41/58; B65D 41/62; B65D 39/04
USPC ..... 215/215, 207, 208, 220, 221; 220/284
See application file for complete search history.

(56) References Cited

U.S. PATENT DOCUMENTS 3,409,159 A * 11/1968 Velt ..... B65D 50/067 215/213
3,703,974 A 11/1972 Boxer et al.
3,782,578 A 1/1974 Bailin
4,095,718 A 6/1978 Kong
4,361,243 A 11/1982 Virtanen
5,317,796 A 6/1994 Hunter
5,356,043 A 10/1994 Glynn
5,402,900 A 4/1995 Glynn
5,429,255 A 7/1995 Glynn
5,437,382 A * 8/1995 Gluckman ..... B65D 50/067 215/204
5,462,181 A 10/1995 Glynn
5,509,580 A 4/1996 Glynn
5,657,905 A 8/1997 Glynn
5,727,704 A 3/1998 Glynn
7,036,672 B2 5/2006 Jaycox
7,111,746 B2 9/2006 Miceli et al.
7,246,715 B2 7/2007 Smith et al.
7,600,648 B2 10/2009 Hamer
7,819,264 B2 10/2010 Brozell et al.
8,584,902 B2 11/2013 Dejonge
2012/0138561 A1 * 6/2012 Brozell ..... B65D 50/041 215/220
2014/0360969 A1 12/2014 Ackerman

* cited by examiner

*Primary Examiner* — Anthony D Stashick
*Assistant Examiner* — Lauren Kmet

(57) ABSTRACT

A double safe child resistant cap for medicine containers includes a cap with a cap main structure having a side wall and a top, and including: a) a first safe child resistant cap mechanism requiring compound movement to unlock; and b) a second safe child resistant cap mechanism including (i) a coupling rod attached to said cap main structure top and extending upwardly and (ii) a push-pull valve connected to said container for dispensing therefrom, said push-pull valve having a force-fit coupling rod receiver, wherein said push-pull valve has a down closed position and an up position, which is an open position to permit dispensing. Another embodiment includes a dosage cup with the coupling rod in place of a cap top coupling rod.

26 Claims, 13 Drawing Sheets

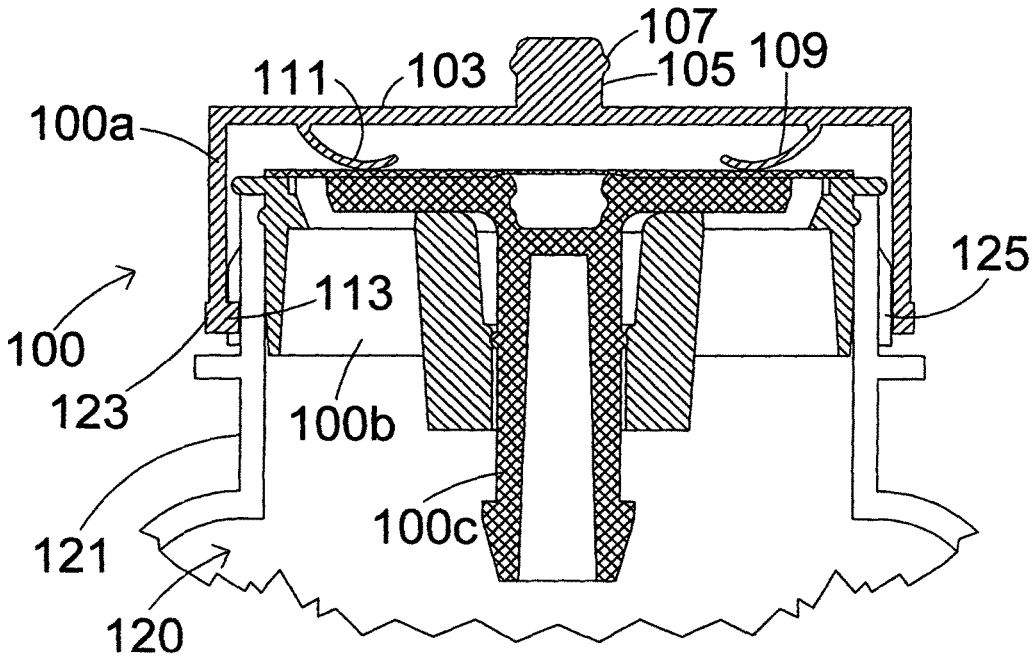
Figure 11
Figure 12
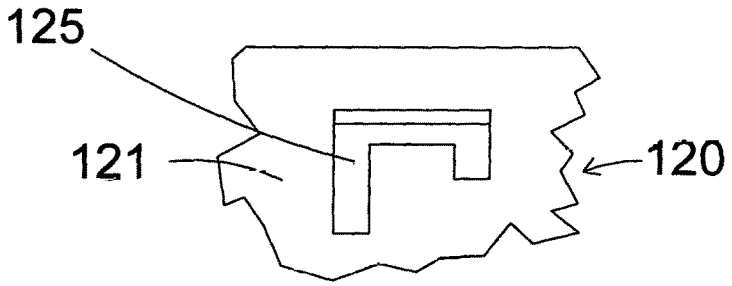

DOUBLE SAFE CHILD RESISTANT CAP

REFERENCE TO RELATED APPLICATIONS

The present application is not related to any pending or issued United States of America or foreign patent or patent application.

BACKGROUND OF INVENTION a. Field of Invention

The present invention and generally relates to child resistant safety caps for containers having potentially dangerous substances to children, such as medications and other harmful or toxic contents. More specifically, the present invention relates to double safe child resistant safety caps and containers wherein a user must overcome two distinct and disparate child resistant features, each of which require compound movements to overcome. In the present invention devices, a first safe child resistant mechanism may be any that require at least two motions. These include press and twist, squeeze and twist, squeeze and lift, slide and lift, and slide and rotate and others. Many are now in the marketplace, while others are known in the art. The present invention goes beyond a single child resistant feature and thus includes a unique second safe child resistant safety mechanism. Therefore in the present invention double safe CR cap, a user must overcome the first safe child resistant mechanism by asserting the correct compound movement and then removing the cap; and next overcome the second safe child resistant cap mechanism by inverting the cap after removal, pushing a coupling rod on the cap into a force-fit coupling rod receiver of a push-pull valve, pulling the inverted cap away from the push-pull valve so as to lift the push-pull valve from its closed position to its open position and subsequently thereby pull the coupling rod from said receiver, and then dispensing contents from the container as needed. Re-securing the double safe child resistant cap is accomplished by attaching the cap onto the container and thereby pushing the push-pull valve back down to its closed position, as well as resetting the first safe child resistant mechanism.

b. Description of Related Art

The following patents are representative of the field pertaining to the present invention:

U.S. Pat. No. 9,580,213 B2 to Dong et al relates to a child resistant closure for a bottle or container. More specifically, the present invention relates to improved two-cap structure assemblies.

U.S. Pat. No. 8,584,903 B2 to DeJonge describes a child resistant container with inverting cap bottom lift features that has a container main body adapted to receive a sprayer container with a vertical spray nozzle top-positioned spray actuator, and has at least one lift rod slot on its bottom; an inner cap for permanent connection to the open top of the container after a spray container is placed therein; and an outer cap with at least one downwardly projecting lift rod. The inner cap has a spray actuator orifice large enough to permit a vertical nozzle of a spray container to pass therethrough and small enough to prevent a spray container spray actuator from passing therethrough. A user removes the outer cap, inverts it and pushes up through the bottom to raise up the spray container nozzle and to push on the spray actuator to dispense.

U.S. Pat. No. 8,544,664 B2 to DeJonge describes a child resistant container with inverting cap bottom lift features that has a container main body adapted to receive a sprayer container with a top-positioned spray activator, and has at least one lift rod slot on its bottom; an inner cap for permanent connection to the open top of the container after a spray container is placed therein; and an outer cap with at least one downwardly projecting lift rod. The inner cap has a spray activator orifice large enough to permit a spray activator of a spray container to pass therethrough and small enough to prevent a spray container connected to the spray activator from passing therethrough. A user removes the outer cap, inverts it and pushes up through the bottom to raise up the spray container enough to expose the spray activator and its nozzle for spray use.

U.S. Pat. No. 8,360,281 B2 to DeJonge describes a child resistant container with inverting cap top key for spray activation that includes (a) a container main body adapted to receive a sprayer container with a top-positioned spray activator and spray nozzle; (b) an inner cap adapted for permanent connection to the open top of the container main body and having at least one key slot to permit at least one key to be inserted therein to permit a spray activator of a spray container to be activated by depression; (c) cut-out(s) to expose the spray activator nozzle when needed; (d) an outer cap to fit over the inner cap and having upwardly projecting key(s) for spray activation when the outer cap is inverted and inserted into the inner cap.

U.S. Pat. No. 7,635,071 B2 to Montgomery et al describes a dispensing closure having a stopping mechanism that limits the rotation of the closure and generally prevents removal of the closure from the container. The dispensing closure includes a cap body, fitment, and container finish. The cap body has a double shell design, which includes at least one drop lug reverse tapered from the inner shell. When the cap body is rotated about the container finish, the reverse tapered drop lug engages at least one lug stop located on the container finish so as to limit the rotation, thereby preventing removal of the cap body from the container finish. The reverse taper of the drop lug maximizes the abutment surface and stability of the drop lug when engaging the corresponding lug stop.

U.S. Pat. No. 5,622,284 to Sawicki describes, in conjunction with a container fitted with a toggle-acting dispensing closure cap, a cap-surmounting secondary control cap to render the container "child-resistant". The control cap is sleeved over and is coaxial with and rotatable about the closure cap. Bridging a generally-cylindrical skirt-like wall of the control cap is a partial, sector-like top wall which covers only a portion of the closure cap including the toggle-like actuator used to open and to close a dispensing port of the container. The partial top wall, which is provided with a restricted through opening, prevents one from impressing effective opening forces on a "press-to-open" section of the actuator. Opening forces can be applied to the actuator only by a probe acting through the restricted opening in the top wall sector of the control cap, and then only when that wall sector overlies the press-to-open section of the actuator.

U.S. Pat. No. 5,509,550 to DeJonge describes a child resistant cap device for containers with a threaded neck openings. It includes an inner cap, an outer cap and a key bar. The inner cap has a top and a sidewall having threads on its inside. The sidewall has on its outside, one of a male attaching mechanism and a female attaching mechanism for receiving and attaching the outer cap onto the inner cap so as to be rotatably fixed thereon. The top of the inner cap has a release key engagement on its outside, and the outside of the inner cap also has one way ratchets or ratchet blocks to permit engagement of the outer cap for rotating thereon, in a single, closing direction and preventing engagement of them for rotating them in a single, opposite, opening direction. The outer cap has a top and a sidewall having on its inside the other of a male attaching mechanism and a female attaching mechanism. The top of the outer cap has a release key bar with a key which is pivotable for 180 degree rotation so as to be engageable with the key arrangement of the inner cap so as to permit opening of the inner cap by rotation of the outer cap when the release key is engaged in the release key engagement.

U.S. Pat. No. 5,314,093 to Gross et al describes a toggle-action container dispensing closure for manipulation between a closed, non-dispensing orientation and an open, dispensing orientation. The closure includes an actuator mounted on a body secured to the container. The actuator is tillable between a closed position and an open position, and the actuator has an engaging tab. A locking ring is mounted on the body for rotation relative to the body and actuator. The ring defines an abutment member for engaging the actuator engaging tab. In one position, the locking ring abutment member lies under the actuator engaging the tab to prevent pivoting of the actuator to the open position. When the locking ring is rotated to another position, the locking ring abutment member clears the actuator engaging tab to permit pivoting of the actuator to the open position.

U.S. Pat. No. 4,887,747 to Ostrowsky et al describes a container closure with a structure that permits it to be readily disassembled and assembled for use on a container defining an opening communicating with the container interior. The closure includes a body and a cover separate from the body. The cover is adapted to be pivoted about an axis between a closed position occluding a dispensing orifice in the body and at least one open position spaced away from the dispensing orifice. An axis-defining structure is provided on either the cover or the body for defining the pivot axis of the closure, and also includes a cam surface around the axis. The other one of the cover or body is provided with a receiving structure for engaging the cam surface to mount the cover to the body for pivoting about the axis. Either or both of the cover and body is elastically deformable. The deformable structure is least stressed when the cover is at one of the open positions. The deformable structure is most stressed when the cover is at over center point between the open and closed positions.

Notwithstanding the prior art, the present invention is neither taught nor rendered obvious thereby.

SUMMARY OF INVENTION

The present invention is directed to a double safe child resistant cap for medicines and other secured contents of a container. The term "cap" as used herein is used broadly to include the cap main structure and the push-pull valve connected or connectable thereto. Thus, the present invention cap includes: a cap for attachment to the container, a cap main structure having a side wall and a top, and including: a) a first safe child resistant cap mechanism that includes a container attachment member, and a primary lock and unlock member that is connected to said attachment member that requires compound movement to open, said lock and unlock member selected from the group consisting of press and twist, squeeze and twist, squeeze and lift, slide and lift, and slide and rotate; b) a second safe child resistant cap mechanism including (i) a coupling rod attached to said top of said cap main structure and extending upwardly therefrom and (ii) a push-pull valve not connected to said cap main structure and connectable to said container for dispensing therefrom, said push-pull valve having a coupling rod receiver, wherein said push-pull valve has a down position, which is a closed position and which prevents dispensing therethrough and has an up position, which is an open position and which permits dispensing therethrough. A user must overcome said first safe child resistant mechanism by asserting the correct compound movement and then removing said cap; and next overcome said second safe child resistant cap mechanism by inverting said cap after removal, connecting said coupling rod into said coupling rod receiver of said push-pull valve, pulling said inverted cap away from said push-pull valve so as to lift said push-pull valve from its closed position to its open position and subsequently removing said coupling rod from said receiver, and then dispensing from said container as needed. The user achieves re-securing said double safe child resistant cap by attaching it to said container and thereby pushing said push-pull valve back to its closed position. The coupling rod and coupling rod receiver may have any connecting mechanism. However, a push in force fit, pull, pull out mechanism; or a screw in, pull, screw out mechanism, are preferred.

In some embodiments of the double safe child resistant cap, the cap main structure is selected from the group consisting of: a single cap structure, and a double cap structure having an outer cap and an inner cap.

In some embodiments of the double safe child resistant cap, the cap main structure is selected from the group consisting of a snap cap, a screw cap, a squeeze and turn cap, and a push and turn cap. Any type of CR ("child resistant") cap could be used in this invention as long as the second CR cap mechanism described above is included. Further examples are locking snap caps and screw caps that use sliders or keys to open (slide and rotate; slide and lift; key in and turn; key in and lift; move key and turn; move key and lift).

In some embodiments of the double safe child resistant cap, the cap main structure is a child resistant screw cap having an outer cap and an inner cap that includes push and twist interlocking detents located on the inside of the outer cap and on the outside of the inner cap.

In some embodiments of the double safe child resistant cap, the push-pull valve includes a valve housing and a moveable valve stem positioned in said housing, and further wherein said valve stem has a top and said force-fit coupling rod receiver is located on said top, and said valve stem includes a stop to prevent removal of said valve stem from said valve housing. The valve stem is typically circular from a top view footprint, but could have any shape, as long as it is complementary to the inside wall(s) of the valve housing and seals and opens as required (has an open up position and a closed down position).

In some embodiments of the double safe child resistant cap, the push-pull valve includes one of a male and a female vertical motion friction interlock set located on said valve housing, and the other of said male and a female vertical motion friction interlock set located on said moveable valve stem. Although one or the other may be conventional or preferred for manufacturing purposes, it does not matter whether the protruding member or the indented member is on the valve housing and vice versa for the valve stem.

In some embodiments of the double safe child resistant cap, the valve housing has an outside wall that includes a container lock component for rending a container insertion thereof permanent.

In some embodiments of the double safe child resistant cap, the valve housing is circular from a top view footprint.

In some embodiments of the double safe child resistant cap, the cap structure is a double cap structure has an outer cap and an inner cap and said inner cap is a circular screw inner cap. In some of these embodiments of the double safe child resistant cap, the outer cap has an underside with engagement protrusions that frictionally lock with said inner cap under downward pressure, and said inner cap has a top with outer cap engagement components to receive said engagement protrusions, and thus said double cap structure is a push and twist double cap structure.

In other preferred embodiments, the present invention is a combination double safe child resistant cap and container, which includes: A) a container having an open top and a cap attachment component at said open top for attachment of said double safe child resistant cap; and B) the double safe child resistant cap for attachment to said container, being the same double safe child resistant cap described everywhere above in this Summary, in all of its various embodiments. As indicated above, a user must overcome said first safe child resistant mechanism by asserting the correct compound movement and then removing said cap from said container; and next overcome said second safe child resistant cap mechanism by inverting said cap after removal, pushing said coupling rod into said force-fit coupling rod receiver of said push-pull valve, pulling said inverted cap away from said push-pull valve so as to lift said push-pull valve from its closed position to its open position and subsequently thereby pulling said coupling rod from said receiver, and then dispensing from said container as needed, and re-securing said double safe child resistant cap by attaching it to said container and thereby pushing said push-pull valve back to its closed position. In some embodiments, the push-pull valve housing has an outside wall that includes a container lock component for rending a container insertion thereof permanent.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE SEVERAL VIEWS OF THE DRAWINGS(S)

The accompanying drawings, which are included to provide a further understanding of the invention and are incorporated in and constitute a part of this specification, illustrate preferred embodiments of the invention and together with the detailed description serve to explain the principles of the invention. In the drawings:

FIG. 11 shows a cut front view of another embodiment of a present invention double safe CR cap with a single main cap structure and a locking keyway, and FIG. 12 shows a partial cut side view of one of the keyways used in the present invention container of FIG. 11;

DETAILED DESCRIPTION OF THE EMBODIMENTS

The present invention relates to double safe child resistant safety caps and systems. In some cases, the invention utilizes a single CR cap with a second CR feature; in other embodiments, a double (inner and outer) CR cap is used with the second feature; in yet other embodiments, wither of the foregoing are included, but with a dosage cap having a part of the second CR feature.

Figure 1:
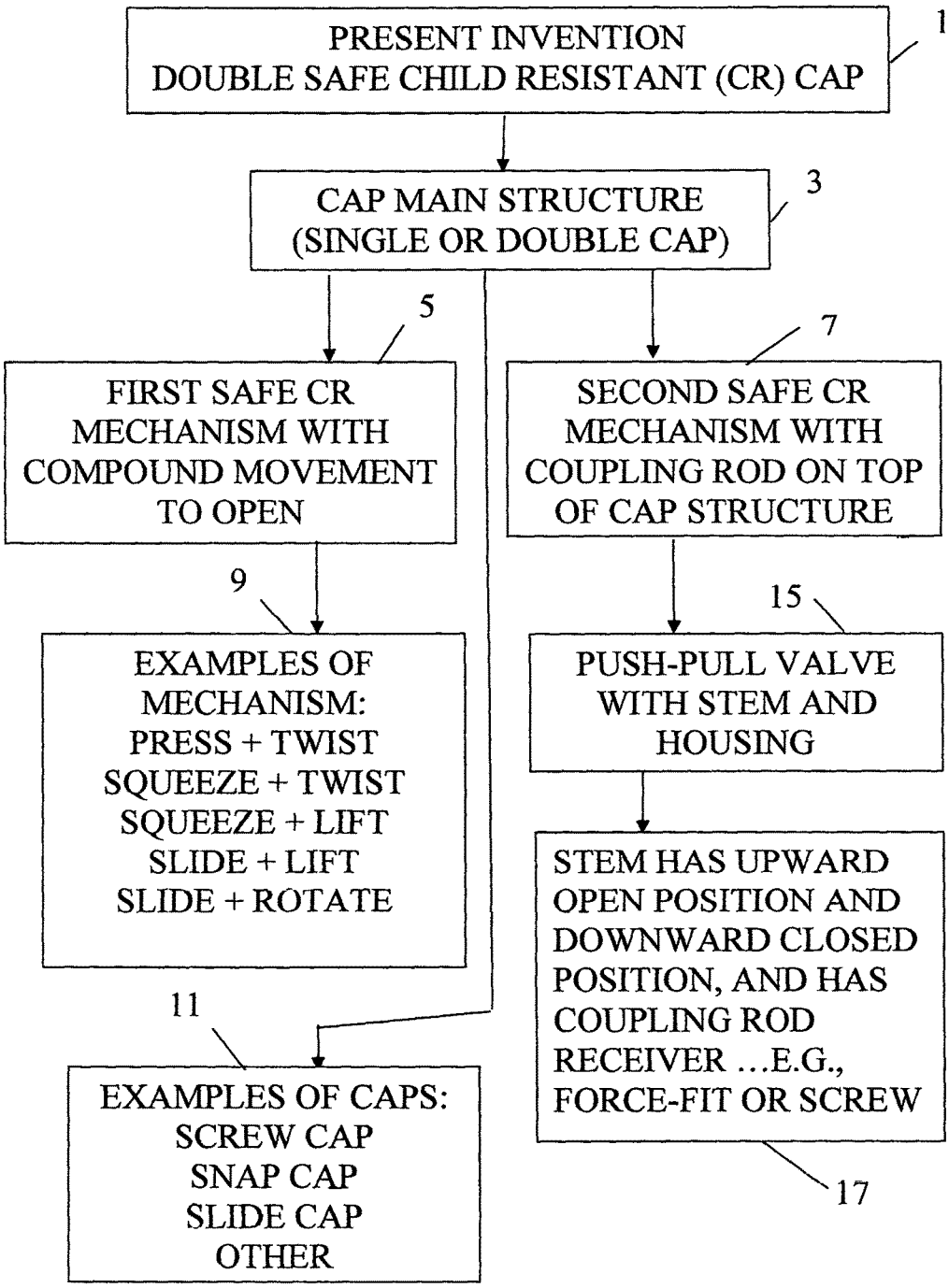
FIG. 1 shows a block diagram of the various relevant components of the present invention double safe CR cap.

FIG. 1 shows a block diagram of the various relevant components of the present invention double safe CR cap, block 1. There is a cap main structure, block 3, and it may be a single or double cap structure. Thus, the cap main structure maybe a single piece or multiple pieces, such as an inner cap nested or fitted under an outer cap. There is a first safe CR mechanism, block 5, that has a compound movement to open. Compound movement child resistant safety caps are well established and by "compound movement" is meant at least two distinct movements that are neither obvious nor intuitive to a child. Block 9 illustrates examples of such mechanisms. These include press and twist; squeeze and twist; squeeze and lift; slide and lift; and slide and rotate. Child resistant safety cap mechanisms with slide features include slide to lock-unlock components, or provide a tool that is inserted and slid, before the second movement is made.

Block 11 of FIG. 1 shows examples of types of caps that may be included in this invention. Any type of cap that is or can be made child resistant may be included, such as screw caps, slide caps and snap caps. (In those embodiments where the coupling rod is on a dosage cup (described in conjunction with FIGS. 13 through 17 below), caps that are not removed, such as CR flip caps, may be included.)

Also shown in FIG. 1 is the second safe child resistant mechanism, block 7. This includes a coupling rod on the top of the cap structure. There's also a push-pull valve with a stem, block 15, wherein the stem has an upward open position and a downward closed position. The stem has a coupling rod receiver, block 17, for receiving the coupling rod on the top of the cap structure, block 7. The coupling rod and coupling rod receiver are complimentary and may have any interlocking configuration, such as a force fit ring, detent or bump, and corresponding receiver or a screw type mechanism with male and female threading, or a drop and twist keyway. Other temporary interconnections may alternatively be included.

Figure 2:
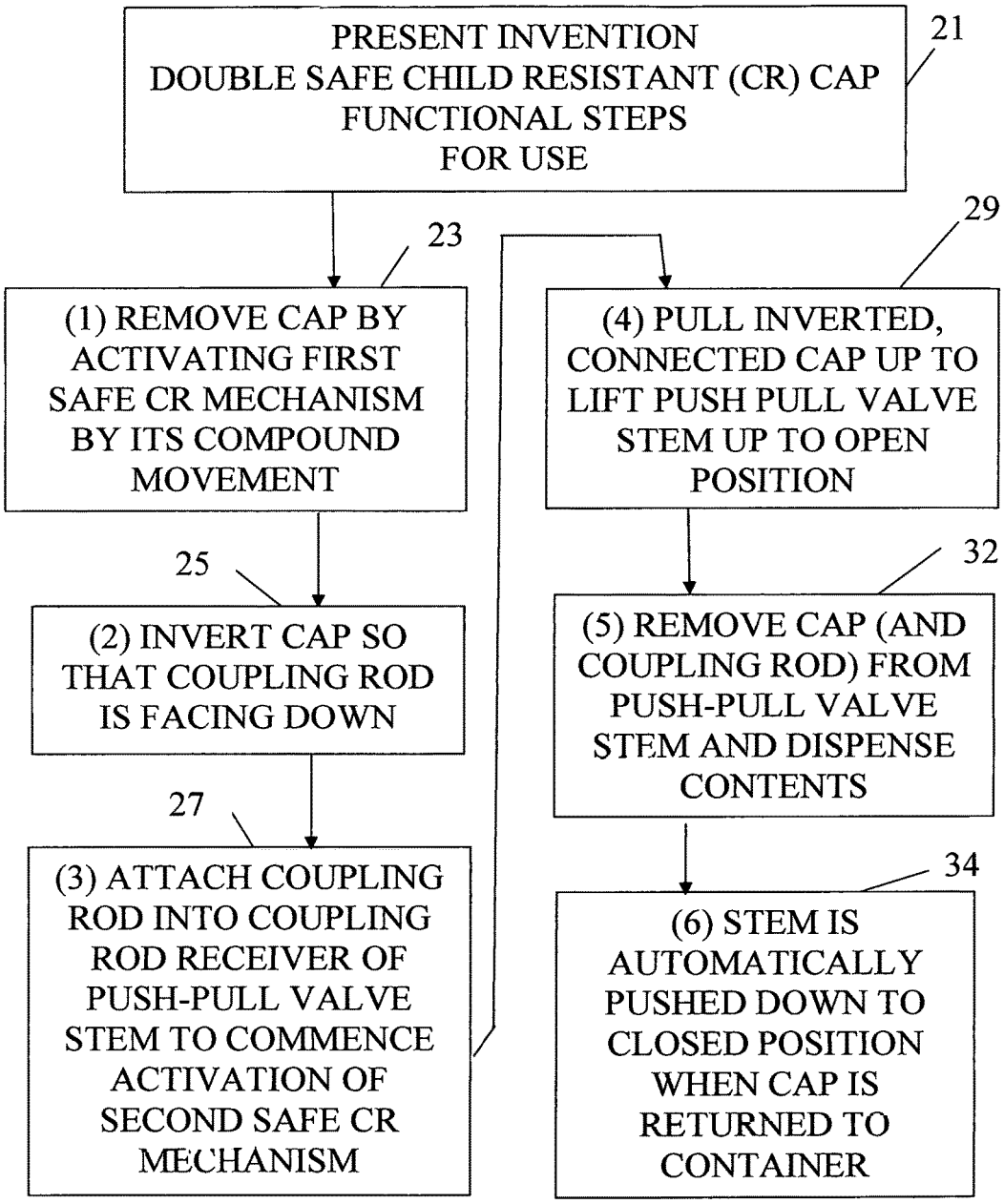
FIG. 2 shows a block diagram of the various relevant functional steps for using the present invention double safe CR cap.

FIG. 2 shows a block diagram of the various relevant functional steps for using the present invention double safe CR cap, block 21. Step 1, block 23, is to remove the cap by activating the first safe child resistant mechanism by its compound movement. Once the cap has been removed, step 2 is to invert the cap so that the coupling rod is facing down, block 25. The third step, block 27, involves attaching the coupling rod onto or into a coupling rod receiver of a push-pull valve stem to begin activation of the second safe CR mechanism. Once the coupling rod is attached to its receiver, step 4 involves pulling the inverted, connected cap with its coupling rod in an upward direction to lift the push-pull valve stem upward to its open position, block 29. Step 5, block 32, is to pull more on the inverted cap or to otherwise remove the cap and coupling rod from the push-pull valve stem while it is in its open position, thereby permitting the dispensing of the contents of the container. The sixth step involves closing the container so as to also close the push-pull-valve down to its closed position. This step 6 is shown in block 34 wherein the stem of the push-pull valve is automatically pushed down to its closed position when the cap is returned to the container.

Figure 3:
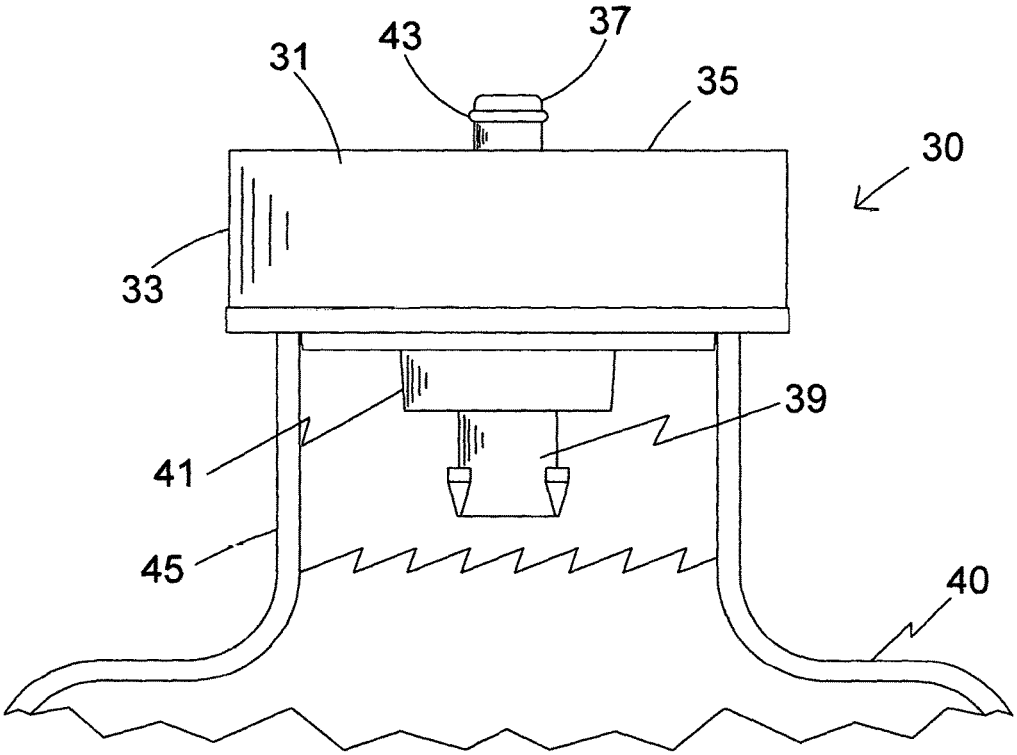
FIG. 3 shows a front view of a present invention double safe CR cap and a cut view of a present invention container to which it is attached.

FIG. 3 shows a front view of a present invention double safe CR cap 30 and a cut view of a present invention container 40 to which it is attached. This Figure represents an overview of the four major components (plus container of some preferred embodiment). Present invention double safe CR cap 30 includes a cap main structure 31. This could be any child resistant safety cap described above and includes, as a point of novelty, coupling rod 37 positioned on its top 35. In this embodiment, coupling rod 37 has a ring 43 that fits into a corresponding coupling rod receiver (not shown in this figure) for opening a push-pull valve. Here, a push-pull valve includes housing 41 attached to the inside of neck 45 of container 40 and push-pull stem 39 that is positioned in its closed downward position in FIG. 3.

Figure 4:
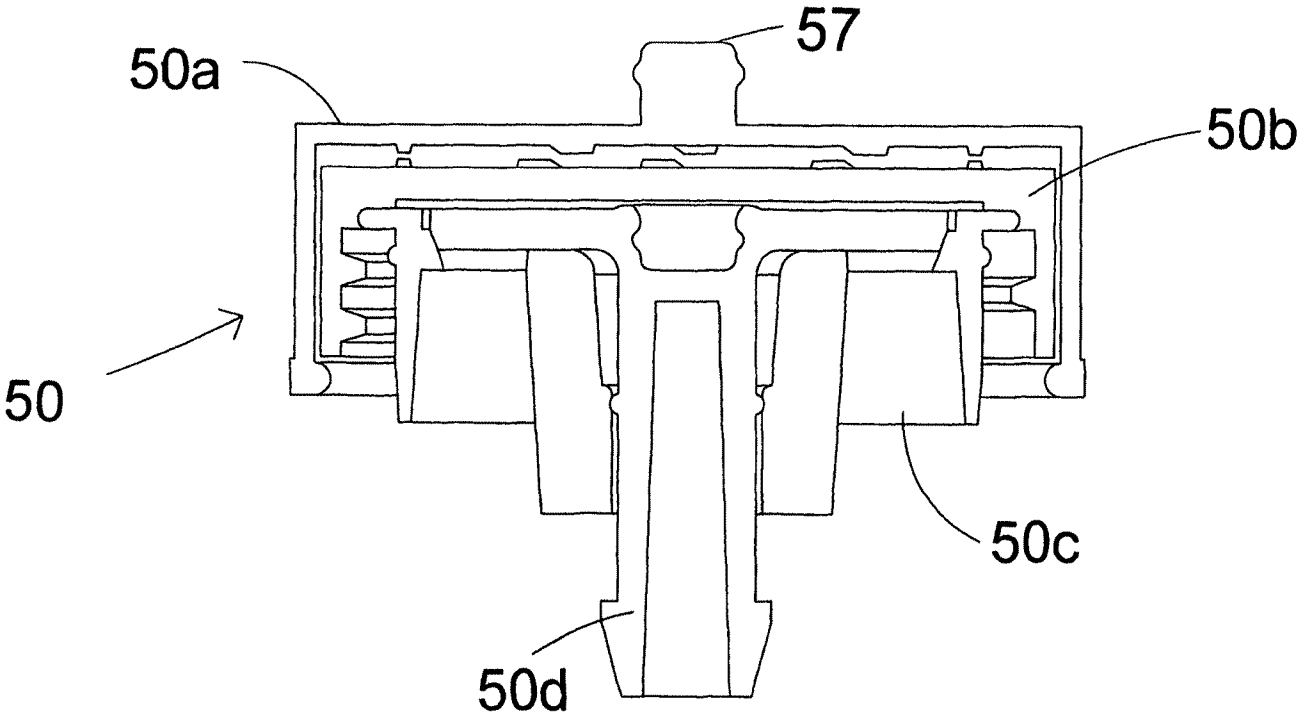
FIG. 4 shows a front cut view of one embodiment of a present invention double safe CR cap.

FIG. 4 shows a front cut view of one embodiment of a present invention double safe CR cap 50. It includes a two component CR cap that has an outer cap 50*a* with coupling rod 57, inner cap 50*b* and a push-pull valve having a main push-pull housing 50*c* for attachment to a container in a fixed position and for housing valve stem 50*d* which moves up and down and has a down position that is closed, as shown in FIG. 4.

Figure 7:
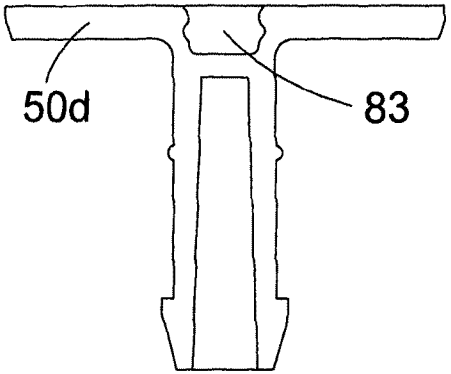
FIGS. 5, 6, 7 and 8 show front cut views of the four major components of the present invention double safe CR cap of FIG. 4.
Figure 8:
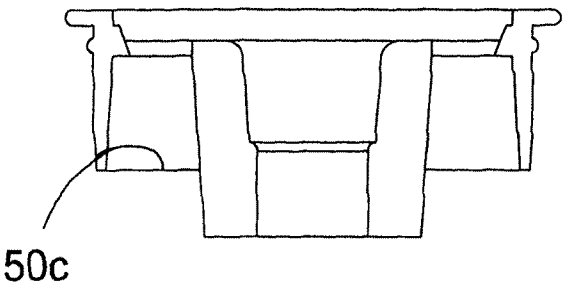
Figure 5:
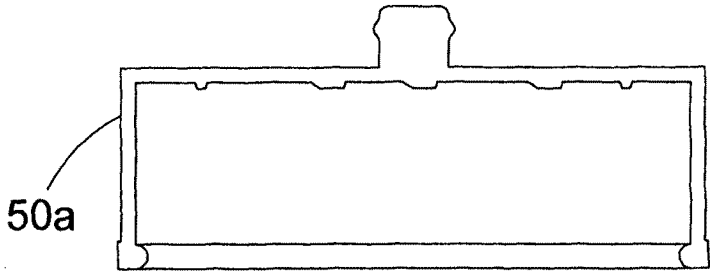
Figure 6:
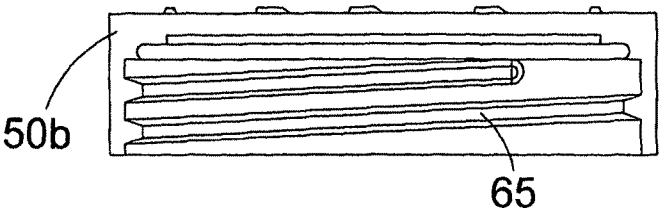

FIGS. 5, 6, 7 and 8 show front cut views of the four major components of the present invention double safe CR cap 50 of FIG. 4. Thus, FIG. 5 shows outer cap 50*a*, FIG. 6 shows inner cap 50*b*, exposing its threads, FIG. 7 shows valve stem 50*d* with its coupling rod receiver 83 and FIG. 8 shows push-pull valve housing 50*c*.

Figure 9:
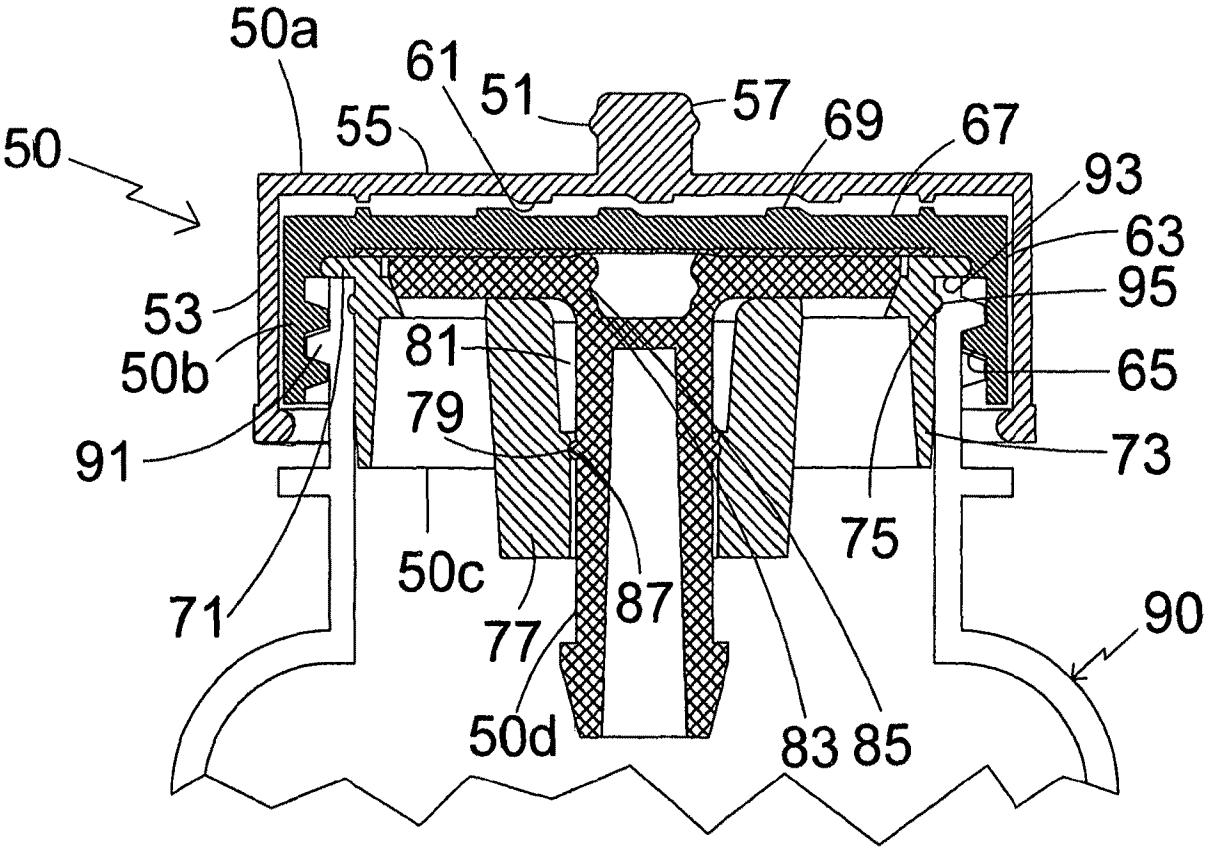
FIG. 9 shows a front cut view of the present invention double safe CR cap shown in FIG. 4 above, attached to a present invention container in a fully closed and double safe state.
Figure 10:
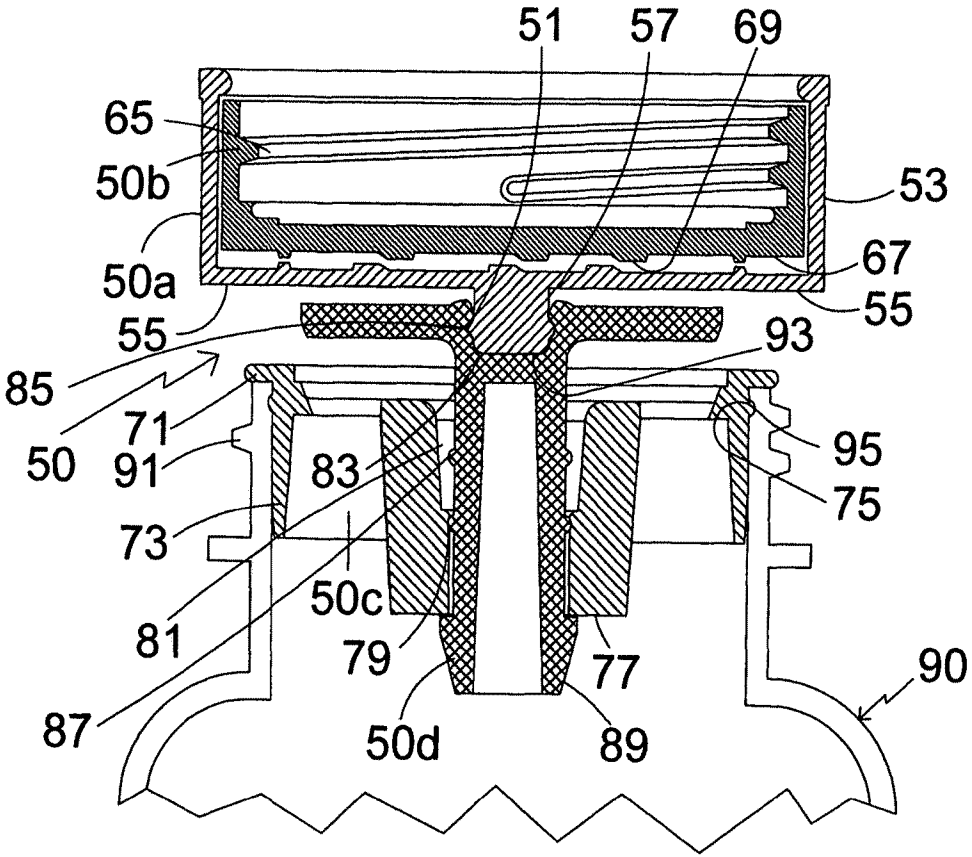
FIG. 10 shows a cut front view of the present invention double safe CR cap and container shown in FIG. 9 above, in a fully open position with the inverted cap still attached to the stem of the push-pull valve that has been lifted up.

FIG. 9 shows a front cut view of the present invention double safe CR cap 50 shown in FIG. 4 above, attached to a present invention container 90 in a fully closed and double safe state and FIG. 10 shows a cut front view of the same present invention double safe CR cap 50 and container 90 shown in FIG. 9 above, in a fully open position with the inverted cap still attached to the stem of the push-pull valve that has been lifted up. Both Figures will be discussed together and like parts are like numbered. In this embodiment the main cap structure is in two parts: outer cap 50*a* and inner cap 50*b*. Outer cap 50*a* is a structure that includes side wall 53 (circular in this embodiment), top 55 and a unique coupling rod 57. Coupling rod 57 has an extended structure with a receiver-engaging end. It could be adapted for any means of attaching to the push-pull stem, such as screwing (threaded) or keyway travel (sized detent), but here is adapted for a push-in force fit. Thus, coupling rod has a bulge or ring 51 (which could be a full circle ring or a broken ring with segments) for force fit into a valve stem coupling rod receiver (discussed below). On the underside of outer cap 50*a* are inner cap engaging detents, such as detent 61. Any type of outer cap-inner cap CR engagement could be used and in this case, it is a press and twist type. Inner cap 50*b* is nested under and in said outer cap 50*a*, but they are loose relative to one another so as to permit outer cap 50*a* to slide around over it (unless pushed down for subsequent twist to open). Inner cap 50*b* has sidewall 63, with threads 65, top 67 and outer cap engaging detents, such as detent 69. When a user rotates outer cap 50*a* without pressing, inner cap 50*b* does not move when it has been screwed onto container 90. However, when a user both presses down on outer cap 50*a* and rotates, inner cap 50*b* rotates with it, and unscrews from the resulting engagement of the detents. Further, these engagement detents are favorably vertically flat for the twist on motion (meaning, downward pressure is not needed to put the cap on the container) and have tapered slide surfaces in the twist off motion so as to require downward pressure to successfully twist open the cap.

The push-pull valve system in FIGS. 9 and 10 includes the valve housing 50*c* and the valve stem 50*d*. Housing 50*c* includes a top 71, an outer wall 73, an inner wall 77 with opening 81 for receiving the stem for up-down limited movement of the stem. Housing outer wall 73 has a force fit ledge 75 for permanent installation into the neck indent 95. This or any other conventional push-pull insert and lock mechanism may be used to secure the push-pull valve to the container. Housing 50*c* also includes a stem ring indent 79 to work in conjunction with valve stem 50*d*. Valve stem 50*d* is in the general shape and size of a conventional push-pull valve stem, but includes a coupling rod receiver 83, with a ring receiving indent 85, for force-fit temporary interlocking with coupling rod 57 described above. Stem 50*d* also has a snap ring 87 to work with housing stem ring indent 79 to hold the stem 50*d* in its closed position, as shown in this FIG. 9. Container 90 includes an open neck 93 and threads 91 to fasten with threads 65 of inner cap 50*b*.

When a user removes the main cap structure (outer cap 50*a* with inner cap 50*b*) by, push and twist compound motion, the cap will be removed from the container, but the push-pull valve stem 50*d* will remain in the closed position and no container content can be dispensed. The user must invert the cap and insert the coupling rod 57 and push it into its receiver 83 of stem 50*d* to secure it temporarily and then pull up to unlock the stem 50*d* so that it moves to its open position, as shown in FIG. 10. More pulling releases the coupling rod 57 from its receiver 83 and the contents of container 90 may then be dispensed. Replacing the cap by screwing it onto the container automatically closes the stem 50*d* back to its closed position.

FIG. 11 shows a cut front view of another embodiment of a present invention double safe CR cap 100, with a single main cap structure and a cap-container locking keyway system, and FIG. 12 shows a partial cut side view of one of the keyways used in the present invention container of FIG.

11. There is cap main structure 100*a*, a valve housing 100*b* and a valve stem 100*c*. In this alternative example, the cap main structure 100*a* is a single piece cap with living springs 109 and 111 to push it up away from the container to maintain the keyway legs such as leg 113 (exposed due to the cut view) in the keyway. On top 103 is coupling rod 105 with ring 107. Valve housing 100*b* and stem 100*c* are the same as valve housing 50*c* and 50*d*, respectively, of FIGS. 9 and 10 above, and, thus, the parts are not numbered or repeated here. Container 120 has built in keyways such as keyway 125 (and an opposite cut view keyway 123) to receive cap legs, such as leg 113 described above. FIG. 12 presents a partial cut view of keyway 125 on wall 121 of container 120. It can now be seen that a user must perform a triple set of motions to open the first CR safe mechanism-press, twist and lift. The next steps are for the second safe CR mechanism to be opened and this is accomplished in the same manner as described above regarding the coupling rod and receiver being used to open the push-pull valve and to close it after dispensing.

Figure 13:
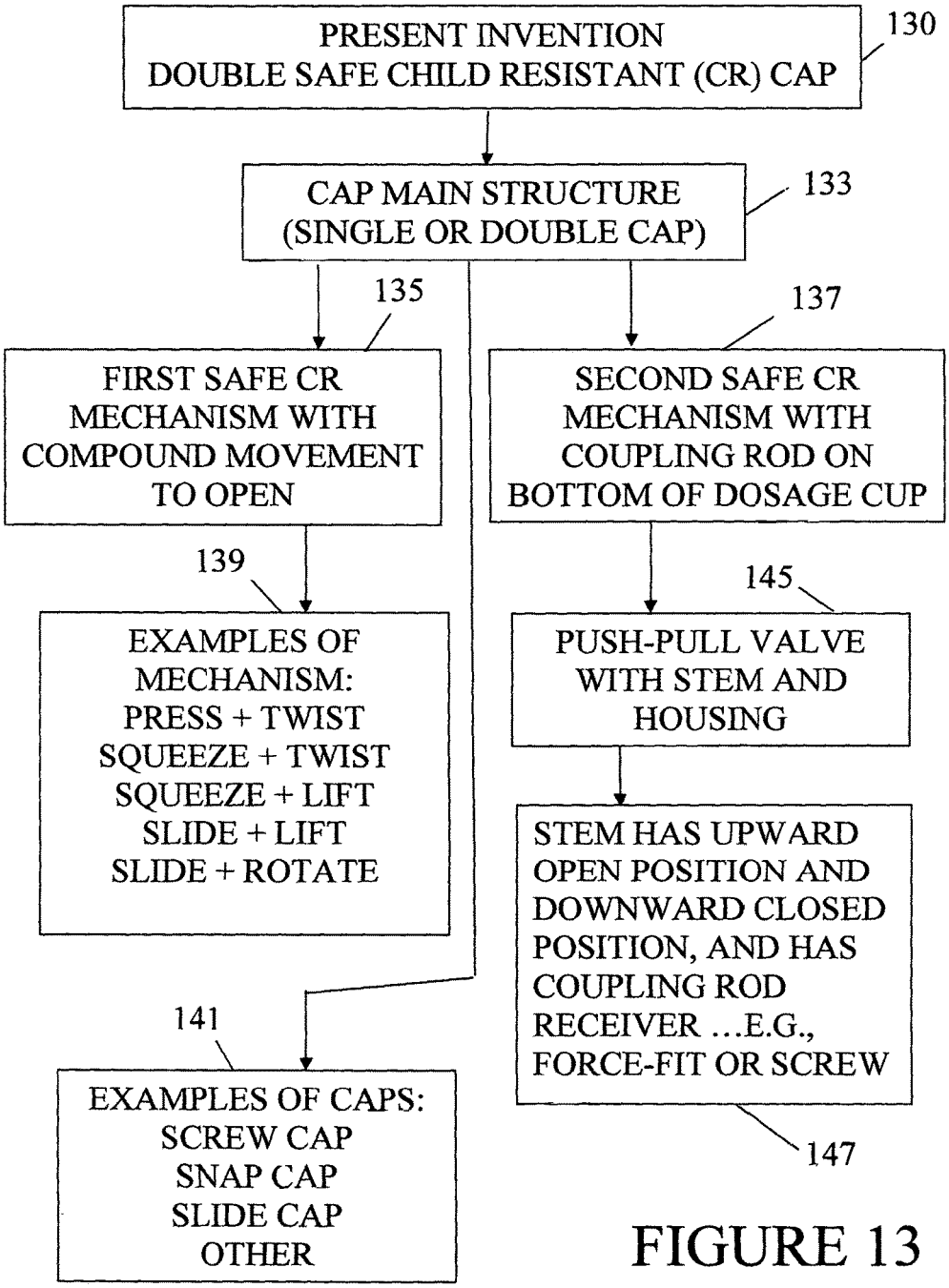
FIG. 13 shows a block diagram of the various relevant components of the present invention double safe CR cap wherein the coupling rod is located on a dosage cup.

FIG. 13 shows a block diagram of the various relevant components of the present invention double safe CR cap wherein the coupling rod is located on a dosage cup, block 130, instead of on the caps as described above. There is a cap main structure, block 133, and it may be a single or double cap structure. As described above, the cap main structure maybe a single piece or multiple pieces, such as an inner cap nested or fitted under an outer cap. There's a first safe CR mechanism, block 135, that has a compound movement to open. Block 139 illustrates examples of such mechanisms. These include press and twist; squeeze and twist; squeeze and lift; slide and lift; and slide and rotate. Block 141 of FIG. 13 shows examples of types of caps that may be included in this invention. Any type of cap that is or can be made child resistant may be included, such as screw caps, slide caps and snap caps.

Also shown in FIG. 13 is the second safe child resistant mechanism, block 137. This includes a coupling rod on the bottom of a dosage cup. There is also a push-pull valve with a stem, block 145, wherein the stem has an upward open position and a downward closed position and the stem has a coupling rod receiver, block 147, for receiving the coupling rod on the top of the dosage cup, block 137. The coupling rod and coupling rod receiver are complimentary and may have any interlocking configuration, such as a force fit ring, detent or bump, and corresponding receiver, or a screw type mechanism with male and female threading, or a drop and twist keyway. Other temporary interconnections may alternatively be included.

Figure 14:
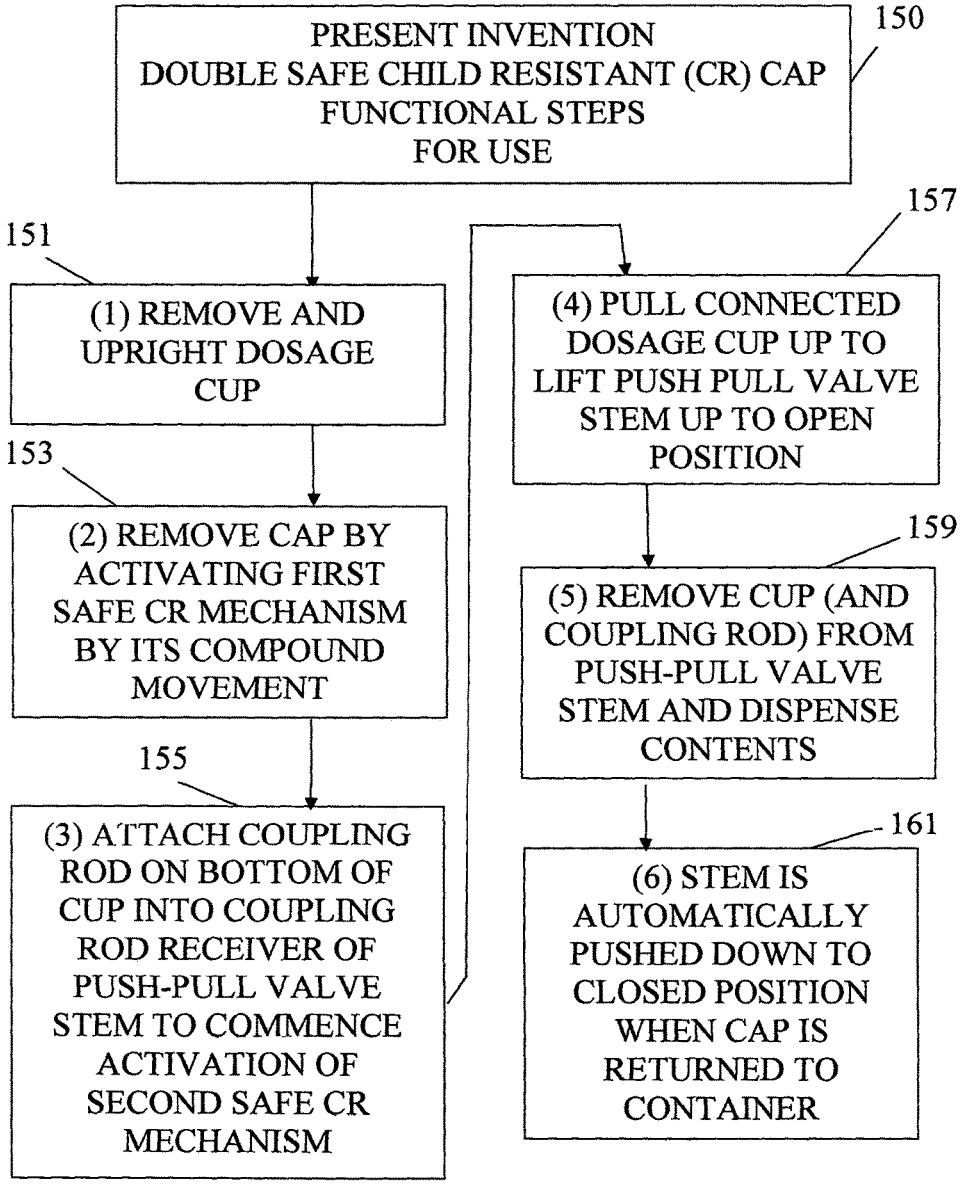
FIG. 14 shows a block diagram of the various relevant functional steps for using the present invention double safe CR cap shown in FIG. 13.

FIG. 14 shows a block diagram, block 150, of the various relevant functional steps for using the present invention double safe CR cap shown in FIG. 13. Step 1, block 151, is to remove and upright the dosage cup and step 2, block 153, is to activate the first safe child resistant mechanism to remove the cap by its compound movement. Once the cap has been removed, the third step, block 155, involves attaching the coupling rod of the dosage cup onto or into a coupling rod receiver of a push-pull valve stem to begin activation of the second safe CR mechanism. Once the coupling rod is attached to its receiver, step 4 involves pulling the connected dosage cup with its coupling rod in an upward direction to lift the push-pull valve stem upward to its open position, block 157. Step 5, block 159, is to remove the dosage cup by pulling more on the dosage cup or to otherwise remove the cup and coupling rod from the push-pull valve stem while it is in its open position (such as unscrewing, if they are threaded), thereby permitting the dispensing of the contents of the container. The sixth step involves closing the container so as to also close the push-pull valve down to its closed position. This step 6 is shown in block 161 wherein the stem of the push-pull valve is automatically pushed down to its closed position when the cap is returned to the container.

Figure 15:
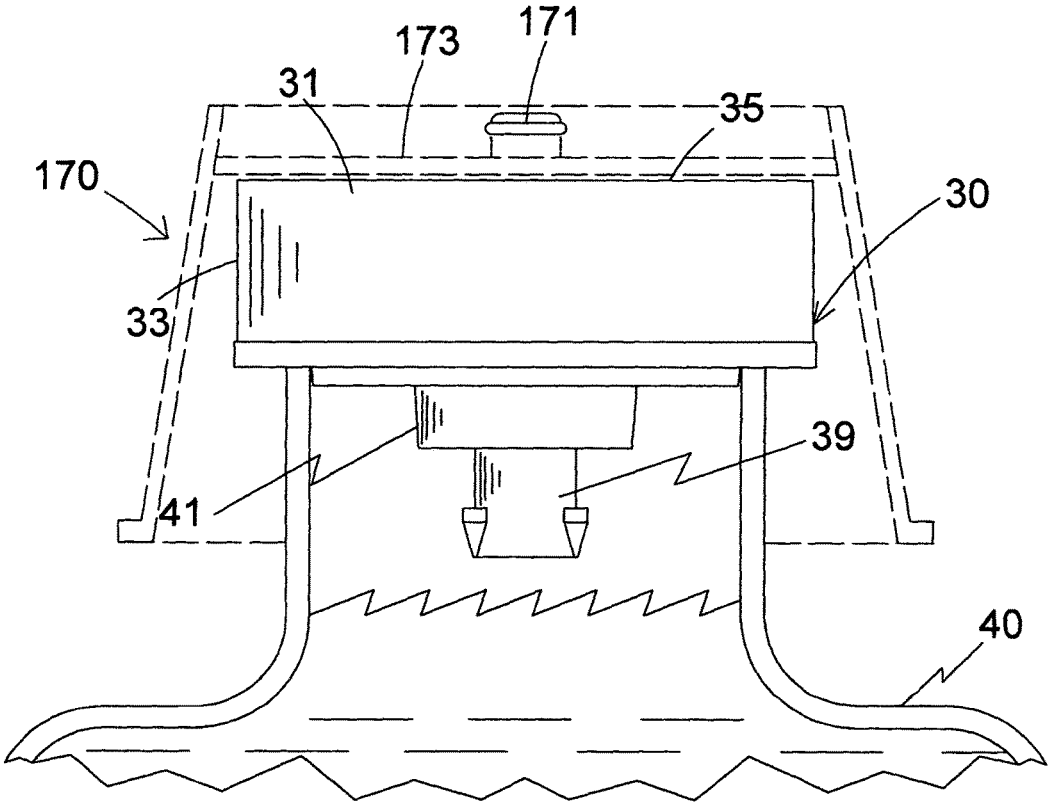
FIG. 15 shows a front view of a present invention double safe CR cap and a cut view of a present invention container to which it is attached, along with a separate but inverted, nested present invention dosage cup; and, FIGS. 16 and 17 show an oblique front view and a cut front view, respectively, of a present invention double safe CR cap dosage cup with a coupling rod.

FIG. 15 shows a front view of a present invention double safe CR cap and a cut view of a present invention container to which it is attached, along with a separate but inverted, nested present invention dosage cup. Specifically, this is container 40 as shown in FIG. 3 above and cap 30 of FIG. 3 above, except that there in no coupling rod on its top. Likewise, push-pull valve housing 41 and stein 39 are the same as in FIG. 3. Given that the top of the cap main structure 31 (with sidewall 33) has no coupling rod, in this embodiment the coupling rod 171 is part of bottom 173 of dosage cup 170. This dosage cup 170 is up righted, the cap 30 is removed by the appropriate CR compound motions and then the coupling rod 171 is attached to its receiver in the push-pull stem 39 and operated to open, as described in FIG. 14 above. When the cap 30 is put back on the container 30, it automatically pushes the stem down to its closed, secure position, such as is shown in FIG. 10 above, except that the dosage cup supplants the inverted cap.

Figure 16:
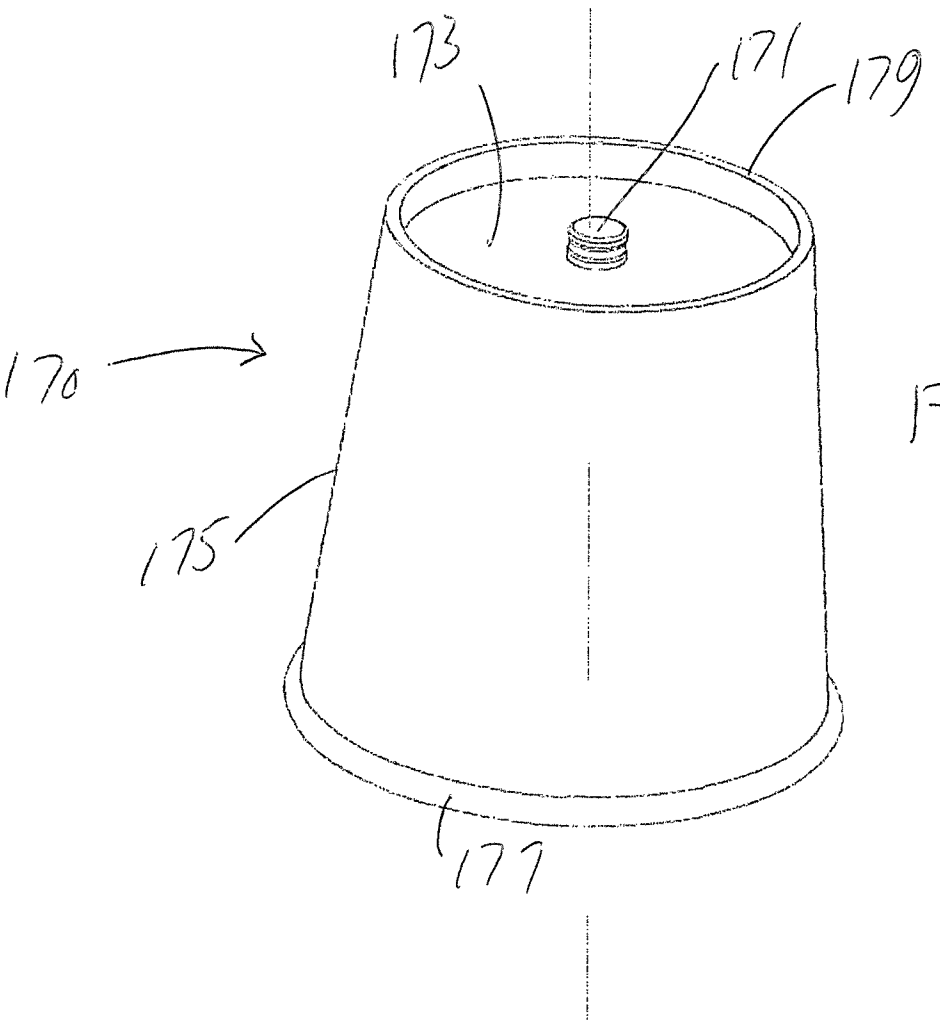
Figure 17:
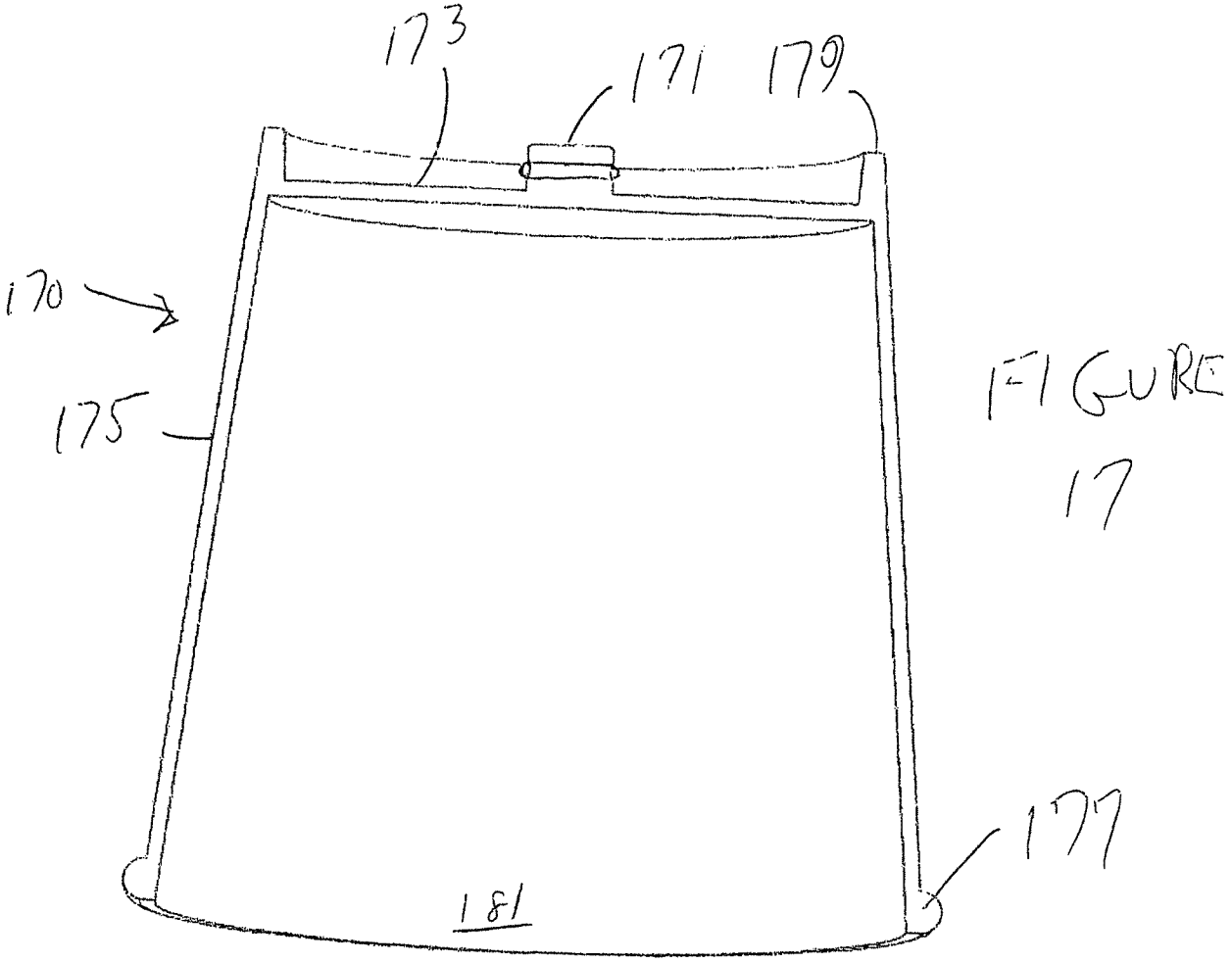

FIGS. 16 and 17 show an oblique front view and a cut front view, respectively, of a present invention double safe CR cap dosage cup 170, and both Figures are discussed here collectively. The cup 170 has an open top 181, a sidewall 175, a lip or rim 177 and a bottom 173 with a bottom rim 179. All of these features are typical of dosage cups provided with liquid medicines, such as cough syrups and liquid (child) antibiotics. However, the unique feature here is that bottom 173 has a coupling rod 171, to be used as described above in the second safe CR mechanisms of the present invention.

Although particular embodiments of the invention have been described in detail herein with reference to the accompanying drawings, it is to be understood that the invention is not limited to those particular embodiments, and that various changes and modifications may be made therein by one skilled in the art without departing from the scope or spirit of the invention as defined in the appended claims. For example, the actual shape of the cap main structure may be any of numerous possibilities as long as its functionality as described is not affected adversely. Thus, it could be, for example, a triangle or pyramid top with internal aspects consistent with its container-triangular, square, oval or circular, for example. As another example, the invention is described with the push-pull valve stem having a coupling rod receiver and with a cap or cup coupling rod. Although it would be more difficult from a manufacturing standpoint, the push-pull valve stem could equivalently have the coupling rod extend upwardly and the cap or cup could have the receiver, without exceeding the scope of the present invention or the claims herein.

What is claimed is:

1. A double safe child resistant cap for medicines and other secured contents of a container, which comprises:

a cap for attachment to a container, including a cap main structure having a side wall and a top, and including:

a) a first safe child resistant cap mechanism that includes a container attachment member, and a primary lock and unlock member that is connected to said attachment member that requires compound movement to open, said lock and unlock member selected from the group consisting of press and twist, squeeze and twist, squeeze and lift, slide and lift, and slide and rotate;

b) a second safe child resistant cap mechanism including (i) a coupling rod attached to said top of said cap main structure and extending upwardly therefrom and (ii) a push-pull valve not connected to said cap main structure and connectable to said container for dispensing therefrom, said push-pull valve having a coupling rod receiver, wherein said push-pull valve has a down position, which is a closed position and which prevents dispensing therethrough and has an up position, which is an open position and which permits dispensing therethrough;

wherein a user must overcome said first safe child resistant mechanism by asserting the correct compound movement and then removing said cap; and next overcome said second safe child resistant cap mechanism by inverting said cap after removal, pushing said coupling rod into said coupling rod receiver of said push-pull valve, pulling said inverted cap away from said push-pull valve so as to lift said push-pull valve from its closed position to its open position and subsequently removing said coupling rod from said receiver, and then dispensing from said container as needed, and re-securing said double safe child resistant cap by attaching it to said container and thereby pushing said push-pull valve back to its closed position.

2. The double safe child resistant cap of claim 1 wherein said cap main structure is selected from the group consisting of: a single cap structure, and a double cap structure having an outer cap and an inner cap.

3. The double safe child resistant cap of claim 1 wherein said cap main structure is selected from the group consisting of a snap cap, a screw cap, a squeeze and turn cap, and a push and turn cap.

4. The double safe child resistant cap of claim 1 wherein said cap main structure is a child resistant screw cap having an outer cap and an inner cap that includes push and twist interlocking detents located on the inside of the outer cap and on the outside of the inner cap.

5. The double safe child resistant cap of claim 1 wherein said push-pull valve includes a valve housing and a moveable valve stem positioned in said housing, and further wherein said valve stem has a top and said force-fit coupling rod receiver is located on said top, and said valve stem includes a stop to prevent removal of said valve stem from said valve housing.

6. The double safe child resistant cap of claim 5 wherein said push-pull valve includes one of a male and a female vertical motion friction interlock set located on said valve housing, and the other of said male and a female vertical motion friction interlock set located on said moveable valve stem.

7. The double safe child resistant cap of claim 5 wherein said valve housing has an outside wall that includes a container lock component for rendering the insertion of said valve housing in said container permanent.

8. The double safe child resistant cap of claim 5 wherein said valve housing is circular from a top view.

9. The double safe child resistant cap of claim 2 wherein said double cap structure has an outer cap and an inner cap and said inner cap is a screw-on cap.

10. The double safe child resistant cap of claim 9 wherein said outer cap has an underside with engagement protrusions that frictionally lock with said inner cap under downward pressure, and said inner cap has a top with outer cap engagement components to receive said engagement protrusions, and thus said double cap structure is a push and twist double cap structure.

11. A combination double safe child resistant cap and container, which comprises:

A) a container having an open top and a cap attachment component at said open top for attachment of said double safe child resistant cap; and B) said double safe child resistant cap for attachment to said container, including a cap main structure having a side wall and a top, and including:

a) a first safe child resistant cap mechanism that includes a container attachment member, and a primary lock and unlock member that is connected to said attachment member that requires compound movement to open, said lock and unlock member selected from the group consisting of press and twist, squeeze and twist, squeeze and lift, slide and lift, and slide and rotate;

b) a second safe child resistant cap mechanism including (i) a coupling rod attached to said top of said cap main structure and extending upwardly therefrom and (ii) a push-pull valve with a valve stem and a valve housing, said push-pull valve not connected to said cap main structure and connectable to said container in said open top for dispensing therefrom, said push-pull valve having a coupling rod receiver, wherein said push-pull valve has a down position, which is a closed position and which prevents dispensing therethrough and has an up position, which is an open position and which permits dispensing therethrough;

wherein a user must overcome said first safe child resistant mechanism by asserting the correct compound movement and then removing said cap from said container; and next overcome said second safe child resistant cap mechanism by inverting said cap after removal, connecting said coupling rod into said coupling rod receiver of said push-pull valve, pulling said inverted cap away from said push-pull valve so as to lift said push-pull valve from its closed position to its open position and subsequently removing said coupling rod from said receiver, and then dispensing from said container as needed, and re-securing said double safe child resistant cap by attaching it to said container and thereby pushing said push-pull valve back to its closed position.

12. The combination double safe child resistant cap and container of claim 11 wherein said cap main structure is selected from the group consisting of: a single cap structure, and a double cap structure having an outer cap and an inner cap.

13. The combination double safe child resistant cap and container of claim 11 wherein said cap main structure is selected from the group consisting of a snap cap, a screw cap, a squeeze and turn cap, and a push and turn cap.

14. The combination double safe child resistant cap and container of claim 11 wherein said cap main structure is a child resistant screw cap having an outer cap and an inner cap that includes push and twist interlocking detents located on the inside of the outer cap and on the outside of the inner cap.

15. The combination double safe child resistant cap and container of claim 11 wherein said push-pull valve includes a valve housing and a moveable valve stem positioned in said housing, and further wherein said valve stem has a top and said force-fit coupling rod receiver is located on said top, and said valve stem includes a stop to prevent removal of said valve stem from said valve housing.

16. The combination double safe child resistant cap and container of claim 15 wherein said push-pull valve includes one of a male and a female vertical motion friction interlock set located on said valve housing, and the other of said male and a female vertical motion friction interlock set located on said moveable valve stem.

17. The combination double safe child resistant cap and container of claim 15 wherein said valve housing has an outside wall that includes a container lock component for rendering the insertion of said valve housing in said container permanent.

18. The combination double safe child resistant cap and container of claim 15 wherein said valve housing is circular from a top view.

19. The combination double safe child resistant cap and container of claim 12 wherein said double cap structure has an outer cap and an inner cap and said inner cap is a screw-on cap.

20. The combination double safe child resistant cap and container of claim 19 wherein said outer cap has an underside with engagement protrusions that frictionally lock with said inner cap under downward pressure, and said inner cap has a top with outer cap engagement components to receive said engagement protrusions, and thus said double cap structure is a push and twist double cap structure.

21. A double safe child resistant cap system for medicines and other secured contents of a container, which comprises:

a cap system for attachment to a container, including a cap main structure having a side wall and a top, and including:

a) a first safe child resistant cap mechanism that includes a container attachment member, and a primary lock and unlock member that is connected to said attachment member that requires compound movement to open, said lock and unlock member selected from the group consisting of press and twist, squeeze and twist, squeeze and lift, slide and lift, and slide and rotate;

b) a dosage cup provided with said main cap structure and having a bottom with an underside containing a coupling rod;

c) a second safe child resistant cap mechanism including a push-pull valve not connected to said cap main structure and connectable to said container for dispensing therefrom, said push-pull valve having a coupling rod receiver to receive and attach to said coupling rod of said dosage cup, wherein said push-pull valve has a down position, which is a closed position and which prevents dispensing therethrough and has an up position, which is an open position and which permits dispensing therethrough;

wherein a user must overcome said first safe child resistant mechanism by asserting the correct compound movement and then removing said cap; and next overcome said second safe child resistant cap mechanism by positioning said dosage cup upright, pushing said coupling rod of said dosage cup into said coupling rod receiver of said push-pull valve, pulling said dosage cap away from said push-pull valve so as to lift said push-pull valve from its closed position to its open position and subsequently removing said coupling rod from said receiver, and then dispensing from said container as needed, and re-securing said double safe child resistant cap by attaching it to said container and thereby pushing said push-pull valve back to its closed position.

22. The double safe child resistant cap system of claim 21 wherein said cap main structure is selected from the group consisting of: a single cap structure, and a double cap structure having an outer cap and an inner cap.

23. The double safe child resistant cap system of claim 21 wherein said cap main structure is selected from the group consisting of a snap cap, a screw cap, a squeeze and turn cap, and a push and turn cap.

24. The double safe child resistant cap system of claim 21 wherein said cap main structure is a child resistant screw cap having an outer cap and an inner cap that includes push and twist interlocking detents located on the inside of the outer cap and on the outside of the inner cap.

25. The double safe child resistant cap system of claim 21 wherein said coupling rod is selected from the group consisting of a force-fit coupling rod with an engagement protrusion; and a screw coupling rod that has threads, and said coupling rod receiver is selected from the group consisting of a force fit receiving recess; and a threaded recess.

26. The double safe child resistant cap system of claim 21 wherein said system further includes a container adapted to receive said cap main structure and having said push-pull valve housing connected thereto.

* * * * *